United States Patent [19]

Humphrey

[11] Patent Number: 4,667,649

[45] Date of Patent: May 26, 1987

[54] ARCHERY BOW

[76] Inventor: Stanley A. Humphrey, 2621 Oak Park Ave., Minneapolis, Minn. 55411

[21] Appl. No.: 735,662

[22] Filed: May 20, 1985

[51] Int. Cl.[4] ..... F41B 5/00

[52] U.S. Cl. ..... 124/24 R; 124/DIG. 1

[58] Field of Search ..... 124/DIG. 1, 24 R, 23 R, 124/88

[56] References Cited

U.S. PATENT DOCUMENTS 4,183,345 1/1980 Caldwell ..... 124/24 R

FOREIGN PATENT DOCUMENTS 47702 2/1977 Japan ..... 124/23 R

*Primary Examiner*—Richard C. Pinkham
*Assistant Examiner*—Benjamin Layno
*Attorney, Agent, or Firm*—Clayton R. Johnson

[57] ABSTRACT

An archery bow having a vertically elongated handle, upper and lower bow limbs that are pivotally connected to the handle intermediate opposite ends of the limbs, a pair of levers pivotally connected to the opposite ends of the handle, swivel arms pivotally mounted to the handle, first and second idler pulleys mounted on the one ends of the swivel arms. A pulley wheel is mounted to each of the remote ends of the limbs. The bowstring connects to and extends from each lever to the respective adjacent idler wheels. The bowstring is reversely bent over each idler wheel and extends therefrom to the adjacent pulley wheels on the limbs remote ends whereby the bowstring is reversely bent thereof. A cable joins and extends between each adjacent lever and limb end portion whereby as the bowstring is drawn the idler wheels are moved toward one another to pivot the swivel arms such that the cables draw the adjacent ends of the limbs to apply bowing forces thereto while bowing forces are also applied to the remote ends of the limbs through the wheels mounted thereon.

13 Claims, 4 Drawing Figures

FIG. 1
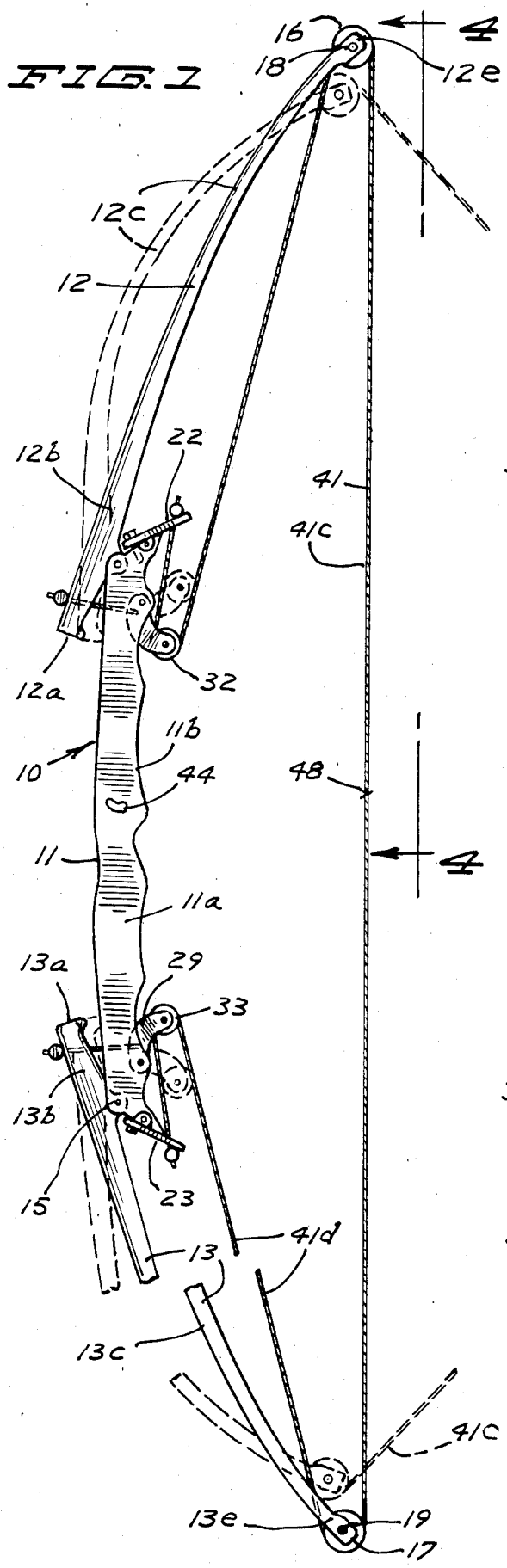
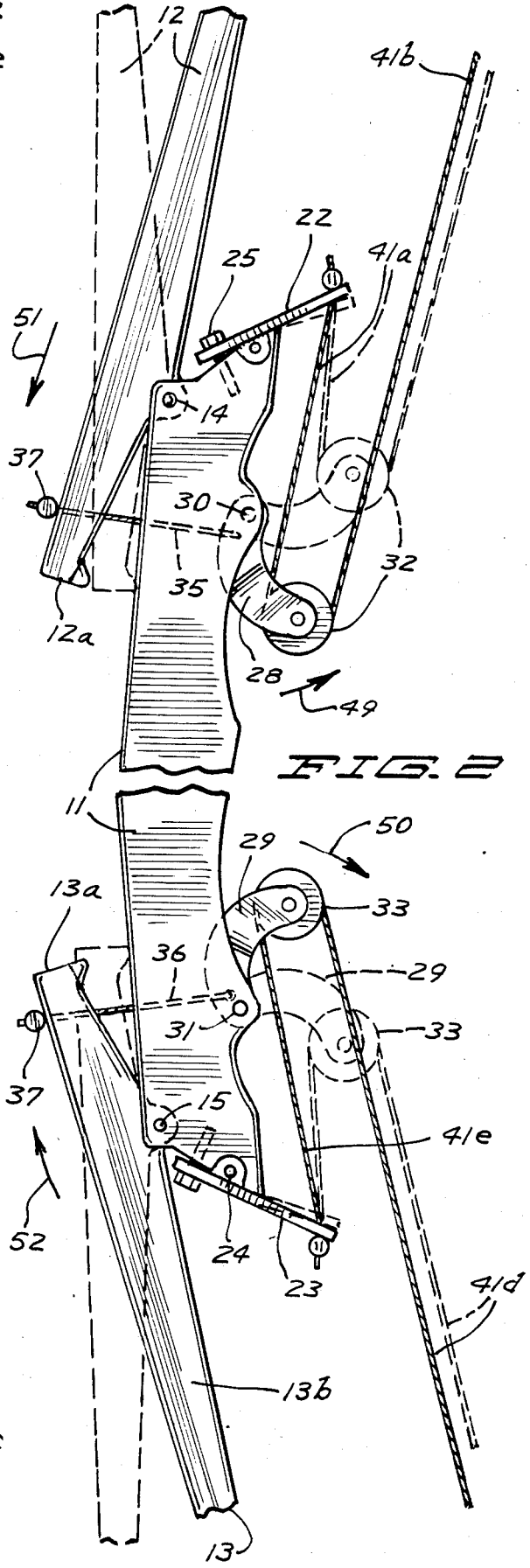
FIG. 2

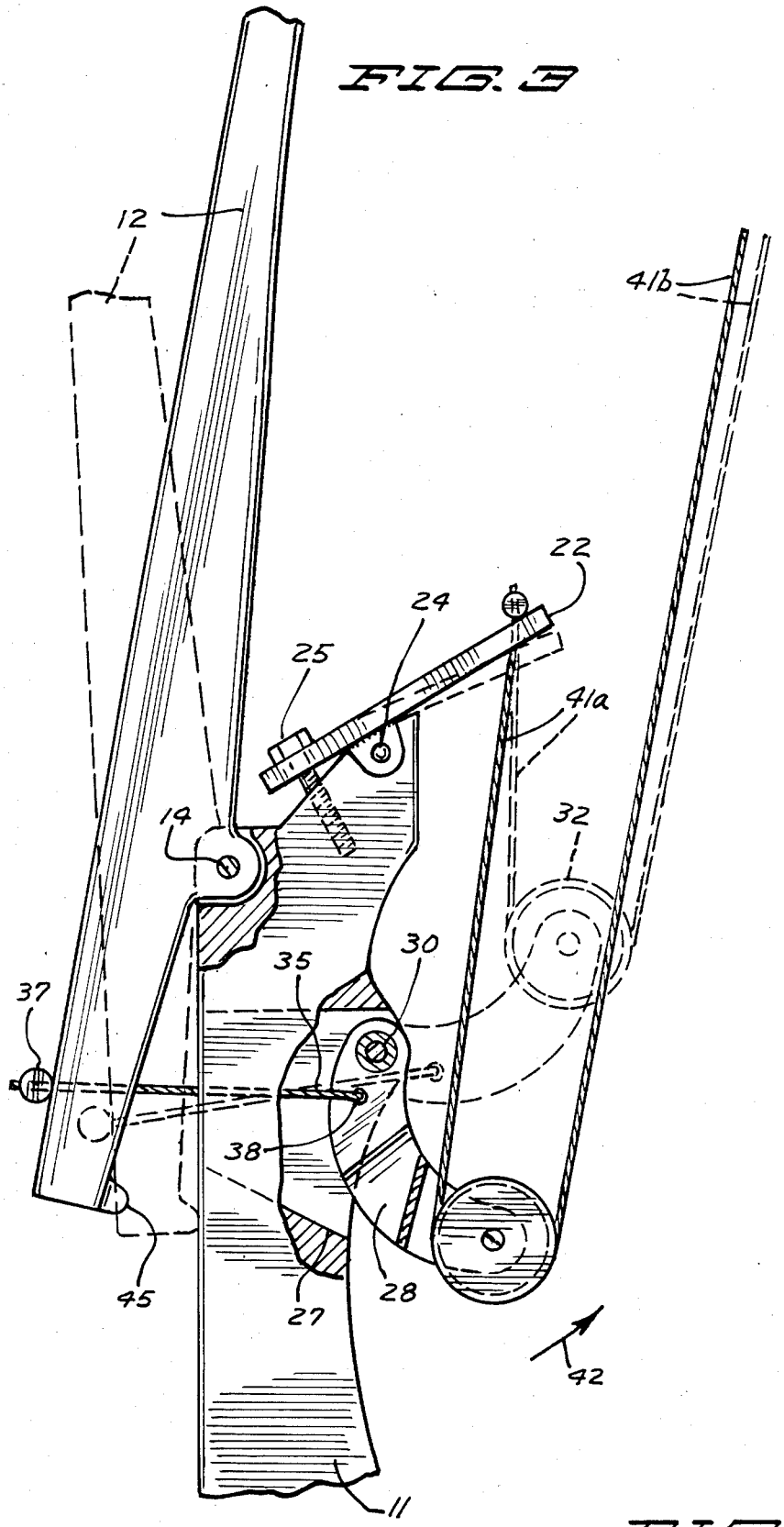
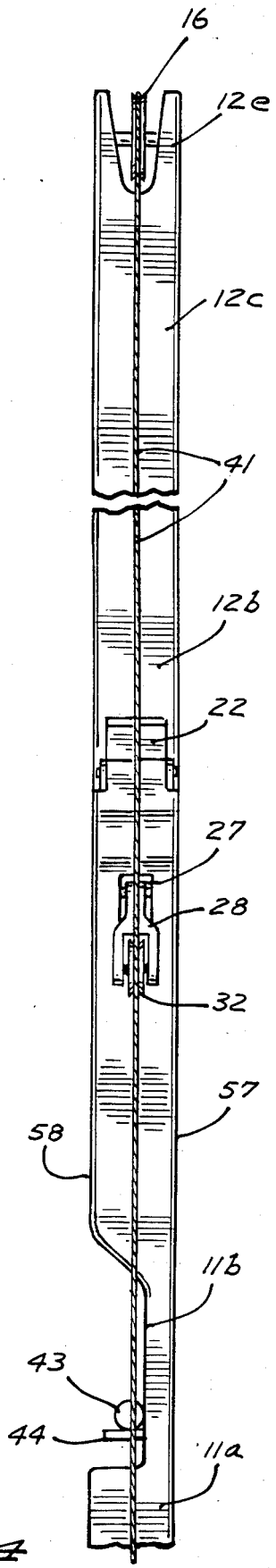
FIG. 4

ARCHERY BOW

BACKGROUND OF THE INVENTION

In prior art compound bows such as disclosed in U.S. Pat. No. 3,486,495 to Allen there are three lengths of a bowstring extending between the remote ends of the limbs which results in interference with true center line shooting and twisting of the limbs along the length thereof. Attempts have been made to overcome the above by providing deflector mechanism on the bow handle for example see U.S. Pat. No. 4,054,118 to McKee et al. However there are still three lenths of the bowstring extending from one limb to the other. U.S. Pat. No. 3,851,638 to Alexander discloses one length of a bowstring that is located entirely rearwardly of the handle to extend from one limb to the other. Further the bow is said to be designed for off-center holding with no off-center thrust problems. However due to the cable connected to the cams there is undesirable twisting of the limbs.

In order to provide an improved archery bow this invention has been made.

SUMMARY OF THE INVENTION

An archery bow having a handle, bow limbs pivotally mounted on the handle, pulley wheels rotatably mounted on the remote ends of the limbs, and a bowstring reversely bent over the pulley wheels and connected to linkages mounted on the opposite ends of the handles which in turn are connected to the adjacent ends of the limbs whereby as the bowstring is drawn the bowstring exerts forces on the pulley wheels to bend the limbs and the linkages exert forces on the adjacent ends of the limbs that also results in the limbs bending.

One of the objects of this invention is to provide in an archery bow new and novel means for equally balancing the stress forces in the two bow limbs during the drawing of the bowstring and the movement of the bowstring to its datum position. Another object of this invention is to provide new and novel means on an archery bow for stressing each bow limb end to end as contrasted to only longitudinally stressing one limb against the other. In furtherance of the last mentioned object it is a still further object of this invention to utilize a draw string having only a single run extending from one limb to the other. A still another object of this invention is to provide new and novel means in an archery bow for obtaining true center line shooting and the elimination of limb twisting.

BRIEF DESCRIPTION OF THE DRAWINGS

FIG. 1 is a side view of the archery bow of this invention with a vertically intermediate part broken away, said view showing the bowstring and limbs in the bowstring datum portion in solid lines and in a bowstring drawn position in dotted line;

FIG. 2 is an enlarged side view of part of FIG. 1 to more clearly show the opposite end portions of the handle and the structure mounted thereon, the intermediate part of the handle not being shown;

FIG. 3 is an enlarged view of part of FIG. 2, parts of the handle being shown in cross section; and FIG. 4 is a fragmentary rear view showing part of the handle and one of the limbs with a vertically intermediate part of the limb broken away and only portions of the bowstring being shown.

Referring to the drawings the archery bow of this invention, generally designated 10, includes a bow handle 11 having longitudinally elongated upper and lower limbs 12, 13 respectively pivotally connected to the front upper and lower corner portions of the handle by pivot members 14, 15 respectively. The pivotal connections of the limbs to the handle are substantially spaced from the adjacent ends 12*a*, 13*a* of the limbs, but many times more closely adjacent to the adjacent ends than to the remote end portions 12*b*, 13*b* of the limbs. The remote end portions 12*a*, 13*a* respectively mount pivots 18, 19 which in turn rotatably mount pulley wheels 16, 17 respectively.

The upper and lower end portions of the handle have relatively stiff, but somewhat resilient levers 22, 23 pivotally connected thereto by pivots 24 which extend through protrusions on the levers with the protrusions extending into recesses in handle end portions. The levers are mounted to converge toward one another in a forward direction in each of their maximum pivoted positions in each angular direction, the lever protrusions being located intermediate opposite ends thereof. The movement of the front end portions of the levers upwardly and downwardly from the respective upper and lower end of the handle is limited by a cap screw 25 that extends through an oversized aperture in the front end portion of the lever and threaded into the adjacent end portion of the handle to permit adjustably varying the maximum pivotal movement of the lever front end portions away from the handle.

Spaced from, but adjacent to, to each of the upper and lower ends of the handle, the handle has a slot 27 extended therethrough. Into the rear end portion of the upper and lower slots there is respectively extended the one ends of upper and and a lower swivel arm 28, 29 that are pivotally connected to the handle by pivots 30, 31 respectively. The opposite bifurcated ends of arms 28, 29 respectively mount idler wheels 32, 33. To an intermediate portion of each of the arms 28, 29 there is pivotally connected at 38 the one end of an anchor cable 35, 36 respectively, the cables extending through slots 27 in the handle and having their opposite ends attached to the end portions 12*b*, 13*b* of limbs 12, 13 respectively adjacent their terminal ends 12*a*, 13*a* by attachment members 37. The attachment of the cables to the limbs is intermediate the ends 12*a*, 13*a* and the pivotal connections of the limbs to the handle, but much closer to the terminal ends than said pivotal connections.

A bow string 41 has one end attached to the end of lever 22 that is on the opposite side of the pivot 24 from screw 25, and thence extends downwardly along run 41*a* to be reversely bent over idler wheel 32. From wheel 32 the bowstring extends upwardly along run 41*b* to be reversely bent over pulley wheel 16, then downwardly along run 41*c* to be reversely bent over wheel 17 and thence upwardly along run 41*d* to be reversely bent over idler wheel 33. From wheel 33 the bowstring extends downwardly along run 41*e* to have its opposite end attached to the rear end of lever 23.

With the bowstring in the datum, solid line, undrawn position of FIG. 1, its runs are substantially, if not completely located, in a single vertical plane that is substantially centered relative to the opposite longitudinal sides 57, 58 of the handle, and extends perpendicular to the axes of rotation of the wheels 16, 17, 32, 33 and the axes of pivots 14, 15, 24, 30, 31. As a result when the bowstring is drawn or released twisting forces are not imparted to the limbs. Further in the bowstring datum position runs 41*a*, 41*b* extend nearly parallel to one another and runs 41*d*, 41*e* extend nearly parallel to one another. Additionally in the datum position runs 41*b*, 41*d* converge toward one another in a forward direction and diverge from run 41*c* in the same direction. Thus as viewed from the side none of the bowstring runs cross one another. The bow handle has a hand grip section 11*a* while just above said section it has a transverse cut out 11*b*. An arrow support 44 is mounted by the handle to extend into the cut out for supporting an arrow 43 with the bowstring in its nock such that the central axis of elongation of the arrow is located in the plane referred to in the preceding paragraph and midway between the axes of rotation of the pulley wheels. Further the nocking point 48 on the bowstring is located about midway between the axes of rotation of pulley wheels 16, 17. Thus the bow is designed for true center shooting.

With the bowstring located in its datum position the axes of rotation of the idler and pulley wheels are located at the corners of a trapezoid with the axes of wheels 16, 17 being at opposite ends of the major base and the axes of wheels 32, 33 being at the corners of the minor base and forwardly of the major base. Also the axis of rotation of wheels 32, 33 in the datum position are closer to one another than pivots 30, 31 which in turn are closer to one another than pivots 14, 15.

With the bowstring in tension (datum position) the bowstring limits the maximum spacing of the wheels 16, 17 such that the limbs are pivoted about the respective pivots 14, 15 to forwardly space the adjacent limb terminal ends 12*a*, 13*a* from the handle and the limbs resiliently urge the wheels 16, 17 to move away from one another. The spacing of the limbs aqjacent ends from the handle is limited by the cables 35, 36 and the pivotal positions of the swivel arms. Further with the bowstring in tension it urges the idler wheels to move away from one another and thereby the swivel arms to pivot in directions to through the cables pull the limbs adjacent ends more closely adjacent to the handle.

Additionally with the bowstring in its datum position in tension, it urges the rear ends of the levers 22, 23 toward one another, the pivotal movement of the levers about the pivots 24 being limited by portions of the levers intermediate the pivots and their rear ends abutting against the handle end portion and/or heads of screws 25. Since the levers are somewhat resilient in the solid line datum positions shown, they are flexed from their no load conditions, and through the bowstring exert forces tending to move the idler wheels away from one a another. As a result there is a force applied at each end portion of each limb acting to bow the limb from the position it would assume if no load (force) were applied to either end of the limb.

Each of the limbs has a thickened end portion 12*b*, 13*b* respectively that extends both above and below the respective pivot 15 while the major portion 12*c*, 13*c* of the respective limb is not nearly as thick whereby all or substantially all of the bowing (bending) of the limbs take place along portions 12*c*, 13*c*. Each of portions 12*b*, 13*b* has a resilient bumper 45 mounted thereon adjacent ends 12*a*, 13*a* that abuts against the handle to limit pivotal movement of the limbs as the bowstring is drawn to its shooting position.

In the bow datum position the wheels 16, 17 are located a substantial distance rearwardly of the handle and a substantial distance respectively above and below the handle while the idler wheels 32, 33 are located vertically intermediate the opposite ends of the handle and spaced rearwardly from the adjacent rear surface part of the handle by a dimension that is many times smaller than the corresponding spacing of the bowstring run 41*c* from the handle. Additionally the spacing of lever arm pivot 30 from pivot 32 and of pivot 31 from pivot 33 is of a dimension that is many times less than the minimum spacing of the bowstring run 41*c* from the handle. Likewise the maximum distance the levers extend rearwardly of the adjacent parts of the handle is many times less than the minimum spacing of bowstring run 41*c* from the handle. With the above described spacing of the wheels from each other and the handle, and the directions of extension of the runs relative to one another, together with the idler wheels being substantially vertically spaced from the arrow support 44, no deflector or other mechanism is required to hold runs 41*a*, 41*b*, 41*e*, 41*d* out of the path of the arrow as it is being shoot.

In use as the bowstring is moved from its datum solid line position to its fully drawn position that in part is shown dotted lines in the drawings the tension in the bowstring increases to move the wheels 16, 17 in part toward one another against the resilient action of the limbs to further bow the limbs. At the same time the idler wheels are moved away from one another which causes the swivel arms 28, 29 to pivot about pivots 14, 15 in the direction ot the arrows 49, 50 respectively. The forces causing the idler wheels to move away from one another urge the rear ends of the levers toward one another, however due to their lengths and low resiliency the movement thereof is small in comparision to the amount of movement of the idler wheels and the bowing of the limbs. As the swivel arms pivot in the above manner the cables 35, 36 are pulled to pull the limb ends toward the handle and exert bending forces through end portions 12*b*, 13*b* to limb portions 12*c*, 13*c* to further bow the limbs in the same general direction that they are being bowed by the forces exerted on the pulley wheels. This movement of limb ends 12*a*, 13*a* and the movement of the wheels 16, 17 toward one another results in the stressing of each limb end to end as contrasted to conventional bows wherein there is stressing of one limb against another, and thus there is a higher storage of energy in the bow of this invention.

As the swivel arms are pivoted in the direction of arrows 49, 50 the cables are connected to the swivel arms such that as the arms are pivoted in the direction of arrows 49, 50 a greater leverage is obtained for pulling the limbs adjacent ends 12*a*, 13*a* toward the handle. When the bowstring has been pulled to its fully drawn position or prior thereto the swivel arms are pivoted to their dotted line positions and the end portions 12*b*, 13*b* are pivoted to positions the bumpers 45 abut against the handle to stop further movement of said end portions in the direction of arrows 51, 52 about pivots 14, 15 respectively. Additionally in the bowstring drawn condition the levers are bent to their dotted line positions wherein the rear ends thereof are more closely adjacent to one another than they were in the bowstring datum position while the limbs are bowed as indicated by dotted lines. It is to be noted the levers can be made of non-resilient material.

By turning the screws 25 the spacing of the rear ends of the levers from the adjacent swivel arm can be adjusted. Thus by adjusting the screws, compensation can be made for differences in the wheels and bow limbs and the stress forces of the two limbs during the drawing of the bowstring or release thereof can be equally balanced. It is noted that in the drawings the rear ends of the levers are shown in solid lines in their maximum pivoted positions in directions toward one another, but by threading the screws further into the handles the longitudinal spacing of the lever rear ends can be increased. Additionally by cutting off part of the rear corner portions of the handle the levers rear end portions can be moved more closely adjacent one another than shown when the screws are turned in an unthreading direction.

What is claimed is:

1. An archery bow comprising an elongated handle having a front surface, a rear surface, a first end portion and a second end portion, first and second elongated resilient bow limbs each having a first end portion and a second end portion, each limb second end portion having a terminal end opposite the limb first end portion, first and second means for pivotally connecting the first and second limbs second end portions to the handle first and second end portion respectively with the terminal ends forwardly of the front surface and more closely adjacent to one another than the limbs first end portions, a first and a second pulley wheel rotatably mounted on the first end portions of the first and second limbs respectively, first and second linkage means connected to the second end portions of the first and second limbs respectively and mounted on the handle first and second end portion respectively for movement between a first position wherein the limbs terminal ends are remote from the handle front surface and a second position wherein the limbs second ends are substantially more closely adjacent to the handle front surface than in their first positions, and an elongated bowstring reversely bent over the pulley wheels, movable between a datum position and a drawn position, and having an intermediate run rearwardly of the handle and extending between the pulley, wheels and opposite end portions in operative association with the linkage means for, as the bowstring is pulled from its datum position to its drawn position, the linkage means move from their first positions to their second positions to apply a bending force to and through the limbs second end portions and to and through the pulley wheels to the limbs first end portions to bend the limbs to store energy in the limbs.

2. The bow of claim 1 further characterized in that each of the linkage means includes swivel arm means connected to the respective limb and mounted to the handle for movement from a first position to a second position to apply an increasing bending force to the limb, each swivel arm means being in responsive association with the respective bowstring end portion for moving the swivel arm means from its first position toward its second position as the bowstring is pulled from its datum position.

3. The bow of claim 2 further characterized in that each swivel arm means includes a swivel arm having a first end portion pivotally mounted to the handle and a second end portion in responsive association with the respective cable end portion and a cable having a first end portion connected to the respective arm and a second end portion connected to the respective limb second end portion for moving the limb second end portion as the bowstring is moved from its datum position to its drawn position to move the swivel arm means to its second position.

4. The bow of claim 2 further characterized in that each of the bowstring end portions has a terminal end, that there is provided a first and a second elongated lever that each has a first end portion and means for mounting the first and second levers on the first and second handle end portions respectively with their first end portions extending rearwardly of the handle and being in more remotely spaced relationship than the swivel arm means, the terminal ends of the respective bowstring end portion being attached to the lever first end portion for urging the lever first end portions toward one another as the bowstring is drawn from its datum position.

5. The bow of claim 4 further characterized in that each swivel arm means includes a swivel arm having a first end portion pivotally mounted to the handle and a second end portion and an idler pulley wheels mounted on the respective swivel arm second , end portion, and that each bowstring end portion is reversely bent over the adjacent idler wheels and includes a run extending from the lever to the adjacent idler wheel and a run extending from the idler wheel to the pulley wheels that is most closely adjacent to the respective idler wheel whereby as the bowstring is moved toward its drawn position the swivel arms are pivoted.

6. The bow of claim 5 further characterized in that each of the swivel arm means includes a cable having a first end portion connected to the adjacent limb second end portion intermediate the terminal end of the same limb and the pivotal connection of the limb to the handle and a first end portion connected to the adjacent swivel arm so that as the swivel arm is pivoted by the bowstring being moved from its datum position an increased mechanical advantage is obtained in pulling the cable to move the limb terminal end toward the handle, the idler wheels in the bowstring datum position being rearwardly of the handle and more closely adjacent to one another than the swivel arms first end portions.

7. The bow of claim 4 further characterized in that each of the levers has an intermediate portion and a second end portion and that the means for mounting the levers comprises means for pivotally mounting the first lever intermediate portion on the handle first end portion, means mounted to the handle and associated with the first lever second end portion for limiting the pivotal movement of the first lever in a direction that the first lever first end portion moves toward the second lever first end portion, means for pivotally mounting the second lever intermediate portion on the handle second end portion, and means mounted to the handle and associated with the second lever second end portion for limiting the pivotal movement of the second lever in a direction that the second lever first end portion moves toward the first lever first end portion.

8. The bow of claim 7 further characterized in that each of the means associated with the second end portion of the respective lever is adjustably mounted to the handle to permit selectively varying the maximum pivotal movement of the lever.

9. An archery bow comprising an elongated handle having a first end portion and a second end portion, a first and a second elongated resilient bow limb each having a first end portion and a second end portion that includes a terminal end, first and second means connected to the first and second limbs respectively intermediate their first end portions and terminal ends for mounting the limbs on the handle for limited movement of the terminal ends relative thereto with the limbs first ends more remotely spaced from one another than their terminal ends, a first and a second pulley wheel mounted on the first and second limbs first end portions respectively, a bowstring associated with the pulley wheel for rotating the pulley wheel, movable between a datum postiion and a drawn position and having an intermediate run portion extending between the pulley wheels and first and second end portions extending away from the first and second pulley wheels respectively, and third and fourth means connected to the first and second limbs respectively and operatively associated with the bowstring first and second end portions respectively for, as the bowstring is drawn from its datum position, moving the limbs second end portions to move their terminal ends relative to the handle and exert a limb bending force through the limbs second end portions, the third and fourth means each including a first and a second idler wheel respectively, an arm having a first end portion rotatably mounting the respective idler wheel and a second end portion, means for mounting the arm on the handle for pivotal movement between a first position and a second position and means for connecting the arm to the adjacent limb second portion to limit the movement of the limb terminal end away from the handle when the arm is in its first position and urge the arm to its first position and move the limb second end portion to move its terminal end toward the handle as the arm is moved from its first position toward its second position, and means for connecting the bowsting first and second end portions to the handle with the bowstring end portions being reversely bent over the first and second idler wheels to have a run extending between the idler wheel and the adjacent pulley wheel and a run extending between the idler wheel and connection of the bowstring end portion to the handle, the arms in their first positions mounting the idler wheels to be more closely adjacent to one another than the pulley wheels are relative to one another.

10. The bow of claim 9 further characterized in that each of the means for connecting the respective bowstring end portion to the handle comprises means for selectively adjustably varying the tension in the bowstring in its datum position.

11. The bow of claim 9 further characterized in that for each of the third and fourth means the connection of the means for connecting the arm to the limbs second end portions is more remotely spaced from the pulley wheel on the same limb than the respective first and second means.

12. The bow of claim 9 further characterized in that the axes of rotatation of the pulley wheels and the idler wheels are parallel to one another and the axes of the pivotal movement of the arms, and that the runs of the bowstring are located in a common plane that is perpendicular to said axes.

13. The bow of claim 12 further characterized in that the handle has a front and a rear surface, that the first and second means includes a first and second pivot that pivotally mounts the first and second limb on the handle first and second end portions respectively with the terminal ends in front of the handle front surface and that the connections of the means for connecting the arms to the limbs second end portions are more closely adjacent to one another than the first and second pivots.

* * * * *

UNITED STATES PATENT AND TRADEMARK OFFICE

CERTIFICATE OF CORRECTION

PATENT NO. : 4,667,649

DATED : May 26, 1987

INVENTOR(S) : Stanley A. Humphrey

It is certified that error appears in the above-identified patent and that said Letters Patent is hereby corrected as shown below:

Column 5, line 39, change "pulley, wheels and" to --pulley wheels, and--.

Column 6, line 17, change "wheels" to --wheel--; line 18, change "second, end" to --second end--; line 20, change "wheels" to --wheel--; and line 22, change "wheels" to --wheel--.

Column 7, line 5, change "wheel" (both occurance) to --wheels--.

Signed and Sealed this

Twenty-seventh Day of October, 1987

*Attest:*

DONALD J. QUIGG

*Attesting Officer*

*Commissioner of Patents and Trademarks*